US012173950B2

(12) United States Patent
Candeo et al.

(10) Patent No.: US 12,173,950 B2
(45) Date of Patent: Dec. 24, 2024

(54) TEMPERATURE CONTROL OF REFRIGERATION CAVITIES WITH A VARIABLE SPEED COMPRESSOR AND A VARIABLE SPEED EVAPORATOR FAN

(71) Applicant: Electrolux Home Products, Inc., Charlotte, NC (US)

(72) Inventors: Marcelo Candeo, Anderson, SC (US); Mario Bittencourt Vargas, Anderson, SC (US); Kevin Cobb, Easley, SC (US); Christopher Barnwell, Anderson, SC (US)

(73) Assignee: Electrolux Home Products, Inc., Charlotte, NC (US)

( * ) Notice: Subject to any disclaimer, the term of this patent is extended or adjusted under 35 U.S.C. 154(b) by 406 days.

(21) Appl. No.: 17/619,365

(22) PCT Filed: Jun. 19, 2019

(86) PCT No.: PCT/US2019/037912
§ 371 (c)(1),
(2) Date: Dec. 15, 2021

(87) PCT Pub. No.: WO2020/256716
PCT Pub. Date: Dec. 24, 2020

(65) Prior Publication Data

US 2022/0260300 A1 Aug. 18, 2022

(51) Int. Cl.
*F25D 11/02* (2006.01)
*F25D 17/06* (2006.01)
*F25D 29/00* (2006.01)

(52) U.S. Cl.
CPC ..... *F25D 11/02* (2013.01); *F25D 17/065* (2013.01); *F25D 29/00* (2013.01);
(Continued)

(58) Field of Classification Search
CPC .... F25D 11/02; F25D 17/065; F25D 2317/06; F25D 2700/12; F25D 2700/122; F25D 2700/14; F25D 29/00
See application file for complete search history.

(56) References Cited

U.S. PATENT DOCUMENTS 5,255,530 A 10/1993 Janke
5,359,860 A * 11/1994 Oh ..... G05D 23/1931 62/97

(Continued)

FOREIGN PATENT DOCUMENTS

JP S595191868 10/1984
JP 2016011830 1/2016

OTHER PUBLICATIONS

Translation of JP 2016-011830 (Year: 2016).*
International Search Report for PCT/US2019/037912 dated Mar. 13, 2020, 2 pages.

*Primary Examiner* — Filip Zec
(74) *Attorney, Agent, or Firm* — Pearne & Gordon LLP

(57) ABSTRACT

A refrigeration appliance includes a refrigeration circuit with a variable speed compressor, an evaporator, and a variable speed evaporator fan. A controller is operatively connected to the refrigeration circuit and is programmed to calculate a heat load ratio as a ratio between the difference between the ambient temperature and the set point temperature of the fresh-food compartment and the difference between the ambient temperature and the freezer compartment reference point; calculate a speed of one or both of the variable speed compressor and the variable speed evaporator fan as a function of the calculated heat load ratio; and operate one or both of the variable speed compressor and the variable speed evaporator fan at the calculated speed. A method of controlling temperature in cavities of a refrigerator is also provided.

23 Claims, 10 Drawing Sheets

(52) U.S. Cl.
CPC ..... *F25D 2317/06* (2013.01); *F25D 2700/12* (2013.01); *F25D 2700/122* (2013.01); *F25D 2700/14* (2013.01)

(56) References Cited

U.S. PATENT DOCUMENTS

| | | | | |
|---|---|---|---|---|
| 5,460,009 | A * | 10/1995 | Wills | F25D 17/065 62/278 |
| 5,533,347 | A * | 7/1996 | Ott | G05D 23/20 236/78 D |
| 6,000,232 | A * | 12/1999 | Witten-Hannah | F25D 17/065 62/89 |
| 6,006,530 | A | 12/1999 | Lee et al. | |
| 6,625,999 | B1 * | 9/2003 | Hu | F25D 29/00 62/186 |
| 6,668,568 | B2 | 12/2003 | Holmes et al. | |
| 6,725,680 | B1 | 4/2004 | Schenk et al. | |
| 6,769,265 | B1 | 8/2004 | Davis et al. | |
| 6,779,353 | B2 | 8/2004 | Hu et al. | |
| 6,802,186 | B2 | 10/2004 | Holmes et al. | |
| 7,490,480 | B2 | 2/2009 | Davis et al. | |
| 8,378,835 | B2 * | 2/2013 | Shin | F25D 17/065 340/635 |
| 8,800,307 | B2 | 8/2014 | Thogersen et al. | |
| 9,772,138 | B2 * | 9/2017 | Hagiwara | F25D 31/005 |
| 10,139,149 | B2 * | 11/2018 | Lim | F25D 11/022 |
| 10,247,466 | B2 * | 4/2019 | Tao | F25D 21/08 |
| 10,337,964 | B2 * | 7/2019 | Kriss | G01N 29/00 |
| 10,655,908 | B2 * | 5/2020 | Qi | F04B 49/065 |
| 10,712,049 | B1 * | 7/2020 | Liu | F25B 1/005 |
| 11,280,536 | B2 * | 3/2022 | Barrios | F25D 29/005 |
| 2007/0089436 | A1 * | 4/2007 | Singh | F25B 49/02 62/225 |
| 2008/0256964 | A1 | 10/2008 | Lee et al. | |
| 2012/0060525 | A1 * | 3/2012 | Schork | F25B 49/02 62/507 |
| 2016/0313054 | A1 * | 10/2016 | Chung | F25D 17/065 |
| 2017/0241696 | A1 * | 8/2017 | Ma | F25D 21/12 |
| 2020/0072545 | A1 * | 3/2020 | Inada | F25D 23/12 |
| 2022/0170678 | A1 * | 6/2022 | Park | F25B 13/00 |

* cited by examiner

TEMPERATURE CONTROL OF REFRIGERATION CAVITIES WITH A VARIABLE SPEED COMPRESSOR AND A VARIABLE SPEED EVAPORATOR FAN

CROSS-REFERENCE TO RELATED APPLICATIONS

Not Applicable.

FIELD OF INVENTION

The following description relates generally to a refrigeration appliance with multiple refrigeration compartments, and more specifically to temperature control of the refrigeration compartments.

BACKGROUND OF INVENTION

Conventional refrigeration appliances, such as domestic refrigerators, typically have both a fresh-food compartment and a freezer compartment or section. The fresh-food compartment is where food items such as fruits, vegetables, and beverages are stored and the freezer compartment is where food items that are to be kept in a frozen condition are stored. A typical refrigerator includes a freezer compartment that operates at a temperature below freezing and a fresh-food compartment that operates at a temperature between the ambient temperature (that is, the temperature in the space outside the refrigerator cabinet) and freezing. The refrigerators are provided with a cooling/refrigeration system for the purpose of generating and dispersing cold air into the refrigeration cavities. The refrigeration system maintains the fresh-food compartment at temperatures around and above 0° C., such as between −2° C. and 10° C. and the freezer compartments at temperatures below 0° C., such as between 0° C. and −20° C. The refrigeration system can include a standard compressor or a variable speed compressor (VSC), a condenser, a condenser fan, an evaporator connected in series and charged with a refrigerant, and an evaporator fan. The evaporator fan circulates cooling air through the refrigerator compartments and improves heat transfer efficiency.

Cooling air can be split, channeled, ducted, and then delivered into the freezer compartment to establish a freezer compartment temperature with a portion of the cooling air further directed to the fresh-food compartment to maintain a desired fresh-food compartment temperature. Cooling air is guided through a passageway (e.g., a cooling air channel or air duct) that is in fluid communication with the cooling system and both the freezer and the fresh-food compartments. A damper or baffle can be arranged within the passageway to selectively allow cooling air to pass into one, the other, or both of the freezer and the fresh-food compartments.

The refrigerators can include an electronic control system to control the refrigeration components, such as the compressor, condenser, evaporator, etc. The control system can use several factors, such as temperature of the freezer and fresh-food compartments, the ambient temperature, upper and lower temperature limits, etc., to vary parameters of the refrigeration components, such as turning on and off the compressor, or the speeds of the compressor, the condenser fan, and the evaporator fan, for example. Temperature sensors can be provided inside and outside the refrigerator to measure the temperature inside the freezer and fresh-food compartments, as well as the ambient temperature.

Some multi-cavity refrigerators have only one automatically controlled compartment (e.g., a "master"), while the other compartments are designated as dependent or "slaves". In some arrangements, the temperature in the slave compartments is adjusted by moving manually a mechanical damper or baffle that distributes the air to the compartments. Efforts to use a variable speed compressor (VSC) in an appliance with a manual damper (or no damper) are currently limited to narrow speed ranges, which reduces the potential benefits of a VSC in terms of energy consumption. For example, it is difficult to apply a VSC to single circuit systems with mechanical dampers as it will not compensate for ambient temperature changes. Because the change in speed affects the temperature balance among the compartments, temperature control of the "slave" compartment usually requires user actions to adjust the damper position, which results in a poor user experience. Another solution is to use an automatic damper, which increases cost. Therefore, it is desirable to provide an energy-efficient temperature control method that addresses these problems.

SUMMARY

The present invention provides a method of controlling temperature in refrigeration cavities by using a variable speed compressor (VSC) and/or a variable speed evaporator fan, and a fixed mechanical damper or no damper at all (e.g., by forming a fixed cooling air channel between the fresh-food compartment and the freezer compartment).

In accordance with one aspect, there is provided a refrigeration appliance including a fresh-food compartment configured for storing food items at a first target temperature above zero degrees Celsius; a freezer compartment configured for storing food items at a second target temperature below zero degrees Celsius; a refrigeration circuit configured for cooling the fresh-food compartment and the freezer compartment and having a variable speed compressor, an evaporator, and a variable speed evaporator fan; and a controller operatively connected to the refrigeration circuit. The controller is programmed to determine a difference between the ambient temperature and a set point temperature of the fresh-food compartment. The controller is further programmed to determine a difference between the ambient temperature and a freezer compartment reference point. The controller is also programmed to calculate a current heat load as a ratio between the difference between the ambient temperature and the set point temperature of the fresh-food compartment and the difference between the ambient temperature and the freezer compartment reference point. The controller is further programmed to calculate a speed of one or both of the variable speed compressor and the variable speed evaporator fan as a function of the calculated current heat load. The controller is also programmed to operate one or both of the variable speed compressor and the variable speed evaporator fan at the calculated speed of the variable speed compressor and the variable speed evaporator fan, respectively.

In the refrigeration appliance according to the foregoing aspect, the ambient temperature can be determined based on a measurement by an ambient temperature sensor.

In the refrigeration appliance according to the foregoing aspect, the ambient temperature can be determined virtually by an estimation based on a response to a thermal load of the refrigerator.

In the refrigeration appliance according to the foregoing aspect, the refrigeration appliance further comprises a cooling air channel between the fresh-food compartment and the freezer compartment. The cooling air channel between the fresh-food compartment and the freezer compartment is formed as a fixed cooling air channel.

In the refrigeration appliance according to the foregoing aspect, the set point temperature of the fresh-food compartment is based on user input via a user interface.

In the refrigeration appliance according to the foregoing aspect, the freezer compartment reference point is a reference parameter determined through simulation and/or laboratory testing with a value between −30 and 10.

In the refrigeration appliance according to the foregoing aspect, the dimensions of the cooling air channel between the fresh-food compartment and the freezer compartment are controlled by a manual damper configured to be operated by a user.

In the refrigeration appliance according to the foregoing aspect, the controller is further programmed to adjust the cooling capacity distribution between the fresh-food compartment and the freezer compartment based on the calculated speed of at least one of the variable speed compressor and the variable speed evaporator fan.

In the refrigeration appliance according to the foregoing aspect, the controller is further programmed to adjust relative quantities of airflow to the fresh-food compartment and the freezer compartment, respectively, based on the calculated speed of at least one of the variable speed compressor and the variable speed evaporator fan.

In the refrigeration appliance according to the foregoing aspect, the controller is a proportional integral ("PI") or a proportional-integral-derivative ("PID") controller programmed to increase a working speed of at least one of the variable speed compressor and the variable speed evaporator fan above the calculated speed of at least one of the variable speed compressor and the variable speed evaporator fan in response to door openings, warm loads, and high ambient temperatures.

In the refrigeration appliance according to the foregoing aspect, the controller being programmed to calculate the speed of one or both of the variable speed compressor and the variable speed evaporator fan as the function of the calculated current heat load (HL_current) includes the controller being programmed to calculate the speed of one or both of the variable speed compressor and the variable speed evaporator fan as a function of a heat load ratio HL_ratio, wherein the controller is programmed to calculate the heat load HL_ratio using the formula:

$$\text{HL_ratio} = \frac{\text{HL_current}}{\text{HL_ref_High}}$$

wherein:

$$\text{HL_current} = \frac{\text{T_amb_measured} - \text{Ref_FZ}}{\text{T_amb_measured} - \text{Ref_FF}}$$

$$\text{HL_ref_High} = \frac{\text{T_base_amb_High} - \text{Base_FZ}}{\text{T_base_amb_High} - \text{Base_FF}}$$

wherein T_amb_measured is the ambient temperature, Ref_FZ is a reference for speed calculation equal to the freezer compartment reference point, Ref_FF is the set point temperature of the fresh-food compartment, T_base_amb_High is a reference value selected as a value higher than an expected normal ambient temperature, Base_FZ is a reference for speed calculation equal to the freezer compartment reference point, and Base_FF is a reference for speed calculation equal to the fresh-food compartment reference point.

In the refrigeration appliance according to the foregoing aspect, the controller is programmed to calculate the speed of at least one of the variable speed compressor and the variable speed evaporator fan in discrete or continuous time intervals as a linear or non-linear function of the calculated heat load ratio HL_ratio, wherein respective speed of the variable speed compressor and the speed of the variable speed evaporator fan equations are determined in simulation or laboratory testing through curve fitting as follows:

$$\text{comp_rpm_min} = f(\text{HL_ratio})$$

$$\text{fan_RPM_evap_min} = f(\text{HL_ratio}).$$

In accordance with another aspect, there is provided a method of controlling the temperature in cavities of a refrigerator cooled by a refrigeration circuit having a variable speed compressor, an evaporator, and a variable speed evaporator fan. The method includes the step of determining an ambient temperature. The method further includes the step of determining a difference between the ambient temperature and a set point temperature of a fresh-food compartment. The method also includes the step of determining a difference between the ambient temperature and a freezer compartment reference point. The method includes the step of calculating a current heat load as a ratio between the difference between the ambient temperature and a set point temperature of the fresh-food compartment and the difference between the ambient temperature and a freezer compartment reference point. The method further includes the step of calculating a speed of one or both of the variable speed compressor and the variable speed evaporator fan as a function of the calculated current heat load. The method also includes the step of operating one or both of the variable speed compressor and the variable speed evaporator fan at the calculated speed of the variable speed compressor and the variable speed evaporator fan, respectively.

In the method of controlling the temperature in cavities of the refrigerator, the ambient temperature is determined based on a measurement by an ambient temperature sensor.

In the method of controlling the temperature in cavities of the refrigerator, the ambient temperature is determined virtually by an estimation based on a response to a thermal load of the refrigerator.

In the method of controlling the temperature in cavities of the refrigerator, the ambient temperature is determined virtually as a linear approximation by measuring the temperature in the fresh-food compartment during the off cycle of the variable speed compressor.

In the method of controlling the temperature in cavities of the refrigerator, the method further includes adjusting relative cooling capacity to the fresh-food compartment and the freezer compartment, respectively, based on the calculated speed of at least one of the variable speed compressor and the variable speed evaporator fan.

In the method of controlling the temperature in cavities of the refrigerator, the set point temperature of the fresh-food compartment is based on user input via a user interface.

In the method of controlling the temperature in cavities of the refrigerator, the freezer compartment reference point is a reference parameter determined through simulation and/or laboratory testing with a value between −30 and 10.

In the method of controlling the temperature in cavities of the refrigerator, the method further includes selecting a reference parameter HL_ratio related to the speed of at least one of the variable speed compressor and the variable speed evaporator fan, wherein the reference parameter HL_ratio is proportional to a ratio between the current heat load and a ratio between a difference between a baseline high ambient temperature and the cavities' reference points.

In the method of controlling the temperature in cavities of the refrigerator, the reference parameter HL_ratio is calculated using a formula:

$$\text{HL_ratio} = \frac{\text{HL_current}}{\text{HL_ref_High}}$$

wherein:

$$\text{HL_current} = \frac{\text{T_amb_measured} - \text{Ref_FZ}}{\text{T_amb_measured} - \text{Ref_FF}}$$

$$\text{HL_ref_High} = \frac{\text{T_base_amb_High} - \text{Base_FZ}}{\text{T_base_amb_High} - \text{Base_FF}}$$

T_amb_measured is the ambient temperature, Ref_FZ is a reference for speed calculation equal to the freezer compartment reference point, Ref_FF is the set point temperature of the fresh-food compartment, T_base_amb_High is a baseline for an ambient temperature that is higher than a typical ambient temperature, Base_FZ is a reference for speed calculation equal to the freezer compartment reference point, and Base_FF is a second reference for speed calculation equal to the fresh-food compartment reference point.

In the method of controlling the temperature in cavities of the refrigerator, the controller calculates the speed of at least one of the variable speed compressor and the variable speed evaporator fan in discrete or continuous time intervals as a linear or non-linear function of the calculated heat load ratio HL_ratio, wherein respective speed of the variable speed compressor and the speed of the variable speed evaporator fan equations are determined in simulation or laboratory test through curve fitting as follows:

$$\text{comp_rpm_min} = f(\text{HL_ratio})$$

$$\text{fan_RPM_evap_min} = f(\text{HL_ratio}).$$

In the method of controlling the temperature in cavities of the refrigerator, the method further includes increasing the working speed of at least one of the variable speed compressor and the variable speed evaporator fan above the calculated speed of at least one of the variable speed compressor and the variable speed evaporator fan in response to door openings, warm loads, and high ambient temperatures.

Other features and aspects may be apparent from the following detailed description, the drawings, and the claims.

BRIEF DESCRIPTION OF THE DRAWINGS

The foregoing and other aspects of the present disclosure will become apparent to those skilled in the art to which the present disclosure relates upon reading the following description with reference to the accompanying drawings, in which.

Figure 1:
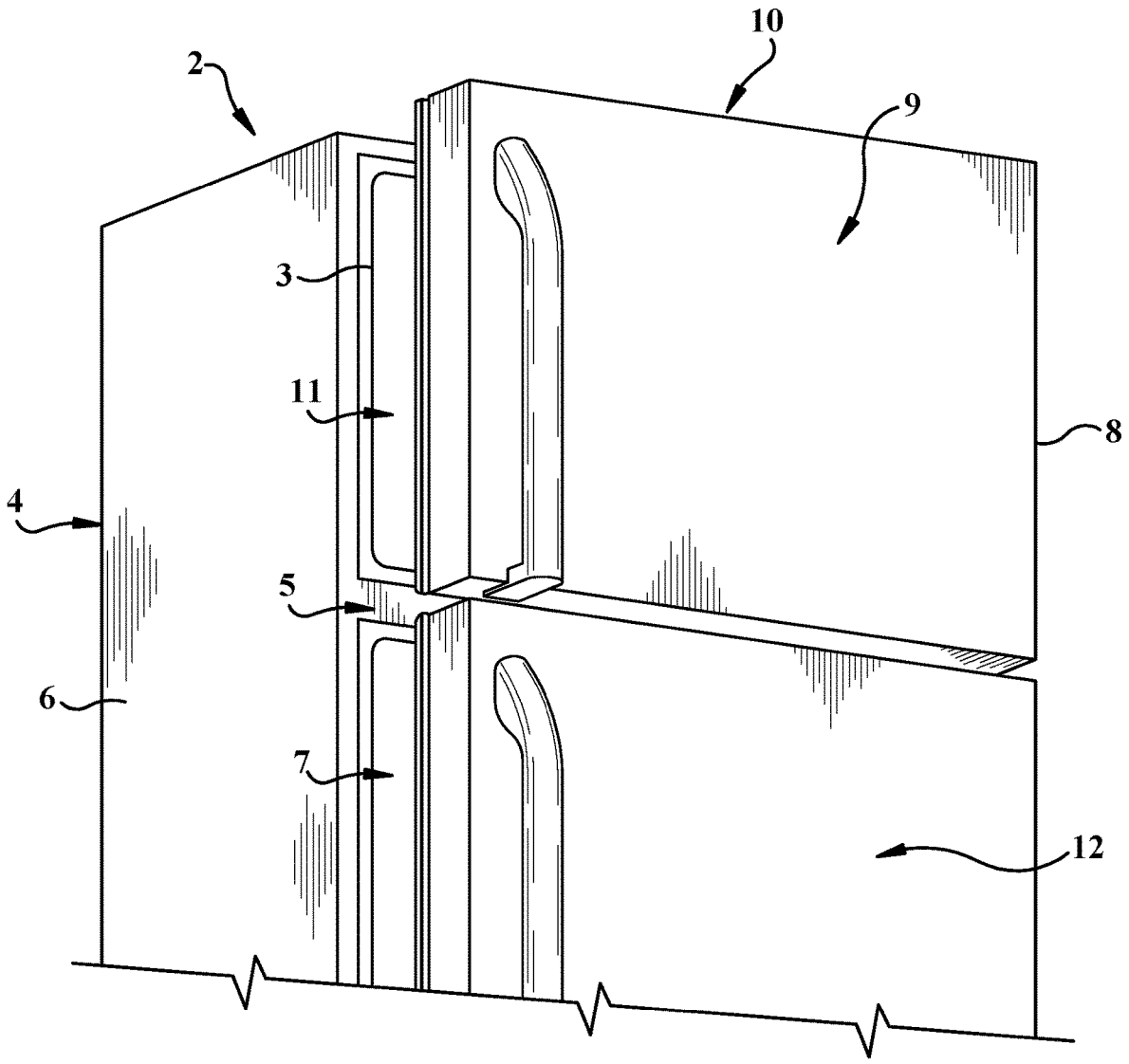
FIG. 1 is a perspective view of a top mount refrigerator.

Throughout the drawings and the detailed description, unless otherwise described, the same drawing reference numerals will be understood to refer to the same elements, features, and structures. The relative size and depiction of these elements may be exaggerated for clarity, illustration, and convenience.

DETAILED DESCRIPTION

Example embodiments that incorporate one or more aspects of the apparatus and methodology are described and illustrated in the drawings. These illustrated examples are not intended to be a limitation on the present disclosure. For example, one or more aspects of the disclosed embodiments can be utilized in other embodiments and even other types of devices. Moreover, certain terminology is used herein for convenience only and is not to be taken as a limitation.

Referring now to the drawings, FIG. 1 shows an insulated cabinet constructed in accordance with the present invention generally indicated at 2. The cabinet 2 includes a cabinet shell 4 defined at least in part by first and second upstanding side panels 6 and 8 that are interconnected and laterally spaced by a top panel 10. Although not shown in this figure, cabinet shell 4 would also include a rear panel and internal reinforcing structure. A liner 3 inside the shell can define spaces. Foam insulation may be used between the cabinet shell 4 and the liner 3. Since the refrigerator cabinet 2 represents a top mount-type refrigerator (i.e., including a freezer compartment 11 located above the fresh-food compartment 7), a divider portion 5 is provided which extends laterally across shell 4 and divides refrigerator cabinet 2 into an upper space that can be used as a freezer compartment 11, and a lower space that can be used as a fresh-food compartment 7.

The refrigerator 2 shown in FIG. 1 is one possible example of a refrigerator 2. For example, the refrigerator shown and described herein is a so-called top mount-type refrigerator with the freezer compartment 11 located above the fresh-food compartment 7. However, in some cases, the refrigerator can have a freezer compartment located below the fresh-food compartment (i.e., a bottom mount refrigerator), a side-by-side configuration of a refrigerator with a fresh-food compartment and a freezer compartment, a stand-alone refrigerator or freezer, etc. In further examples, the refrigerator 2 could be provided with multiple compartments or with compartments located above and/or laterally with respect to one another. Whatever arrangement of the freezer compartment and the fresh-food compartment is employed, typically, separate access doors are provided for the refrigerated compartments so that either compartment may be accessed without exposing the other compartment to the ambient air. For example, a door provides access to the freezer compartment, and a door provides access to the fresh-food compartment of the refrigerator. Although the embodiments described in detail below, and shown in the figures concern a top mount-type refrigerator, the refrigerator can have any desired configuration including at least one compartment for storing food items, at least one door for closing the compartment(s), and a condenser/cooling system configured to remove heat energy from the compartment(s) to the outside environment, without departing from the scope of the present invention. Accordingly, it is to be appreciated that the refrigerator 2 shown in FIG. 1 comprises only one possible example, as any number of designs and configurations are contemplated.

Turning to the shown example of FIG. 1, the freezer compartment 11 includes a freezer compartment door 9 and the fresh-food compartment 7 includes a fresh-food compartment door 12. Both the fresh-food compartment 7 and the freezer compartment 11 define substantially hollow interior portions and may include shelves, drawers, or the like.

A cooling air channel or air duct can be formed between the freezer 11 and fresh-food 7 compartments to allow air flow between the two compartments 7, 11. In one embodiment, the cooling air channel can be a fixed cooling air channel formed with specific fixed dimensions that do not vary during the operation of the refrigerator 2. In certain embodiments, the dimensions of the cooling air channel between the freezer 11 and fresh-food 7 compartments can be controlled by a manual damper configured to be operated by the user.

Figure 2:
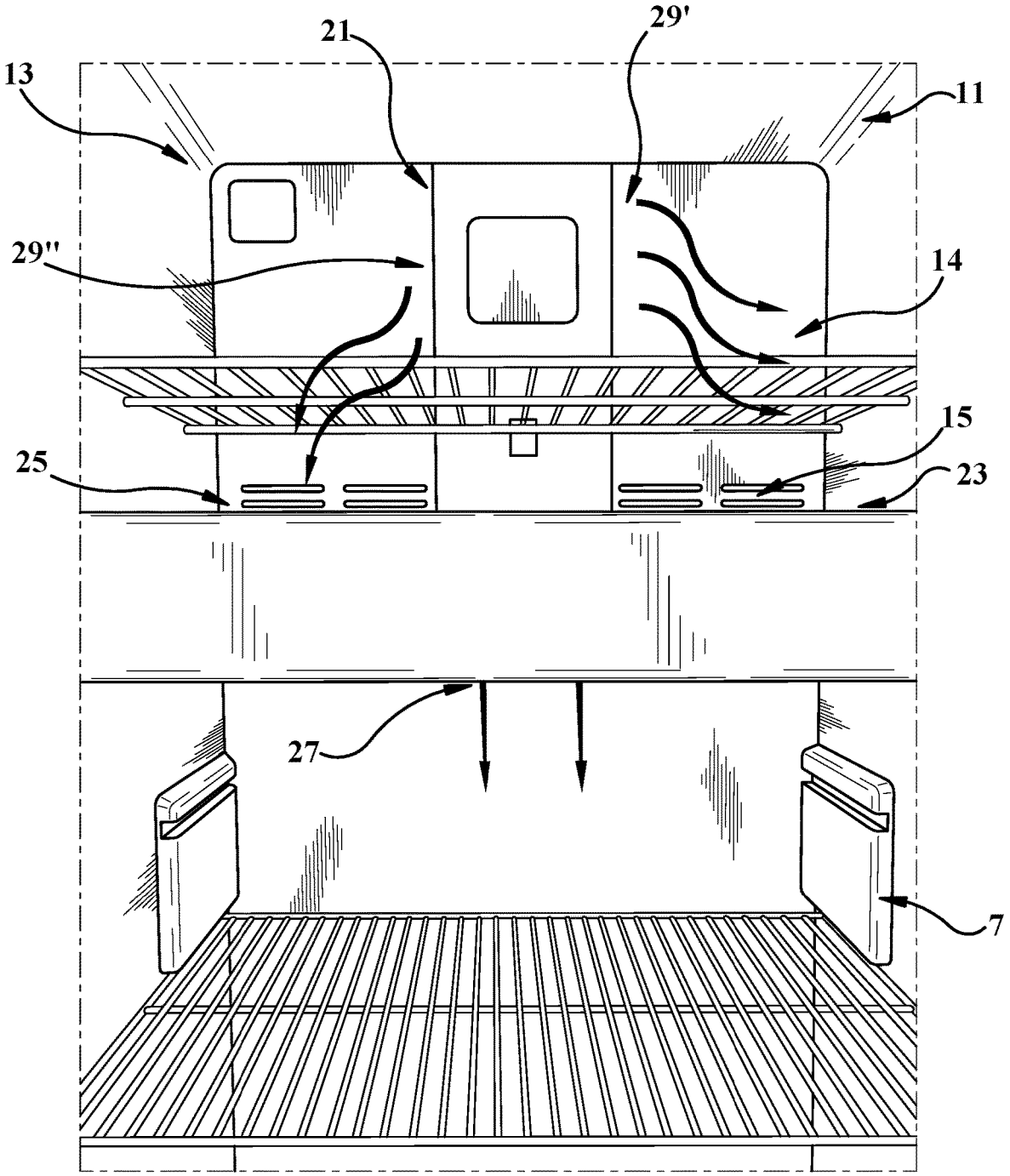
FIG. 2 is a front view looking into the compartments of the refrigerator of FIG. 1, showing an air tower assembly, according to an embodiment.

The example of FIG. 2 shows the interior of the freezer compartment 11 and the fresh-food compartment 7 of the refrigerator 2. The interior of the freezer compartment 11 can include an air tower 21 secured to the back of the freezer compartment 11 to the rear wall 13 of the liner 3, facing the interior of the freezer compartment 11. In one embodiment, the air tower 21 may be attached to the lower center area of an evaporator cover 14. The evaporator coil cover 14 can be coupled to the rear liner 13 by any suitable mechanical (e.g., screws, rivets, nuts and bolts, etc.), chemical (e.g., adhesive, epoxy, etc.), or other type of fastener. Vents 15 are provided in a lower portion of the evaporator coil cover 14 that allow a circulation of air pulled by the evaporator fan (shown in FIG. 5) through the evaporator. Although the example of FIG. 2 shows the evaporator coil cover 14 in the freezer compartment 11, it is contemplated that the evaporator coil cover 14 can be located inside the fresh-food compartment 7, in between the freezer compartment 11 and the fresh-food compartment 7 or even externally forming an evaporator compartment, without departing from the scope of the present invention.

Figure 3A:
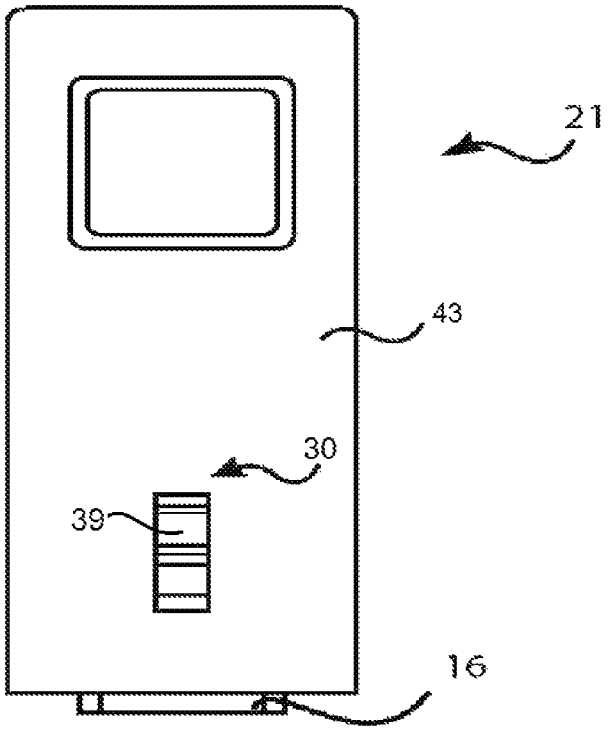
FIG. 3A is a front view of the air tower of FIG. 2.

As shown in FIG. 3A, the air tower 21 serves to distribute cool air discharged from the evaporator fan (shown in FIG. 5) throughout the freezer compartment 11 and the fresh-food compartment 7 of the refrigerator 2. In one embodiment, the bottom edge 16 of the air tower 21 is insertable into a foamed-in air duct that is in fluid communication with the fresh-food compartment 7 of the refrigerator 2, so to permit the air tower 21 to provide cool air discharged from the evaporator fan to the fresh-food compartment 7. Vents 31 (shown in FIG. 3B) are disposed on top and upper sides of the air tower 21 to distribute cool air to the freezer compartment 11. Vents 35 are disposed on the lower sides of the air tower 21 to return air from the freezer compartment 11 to the air tower 21 for recirculation.

Turning back to FIG. 2, the bottom of the freezer compartment 11 includes a floor 23, which is a portion of the wall or mullion 5 that separates the freezer compartment 11 from the fresh-food compartment 7. The floor 23 may also include inlet openings 25 that may serve as air ducts that direct return air from the fresh-food compartment 7 to the freezer compartment 11 above. Air that has circulated through the fresh-food compartment 7 may return to the freezer 11 through the inlet openings 25. The floor 23 may also include an exhaust opening 27. The exhaust opening 27 serves as an air duct in the floor through which cold air (i.e., supply air) from the freezer compartment 11 is directed to the fresh-food compartment 7.

Figure 4A:
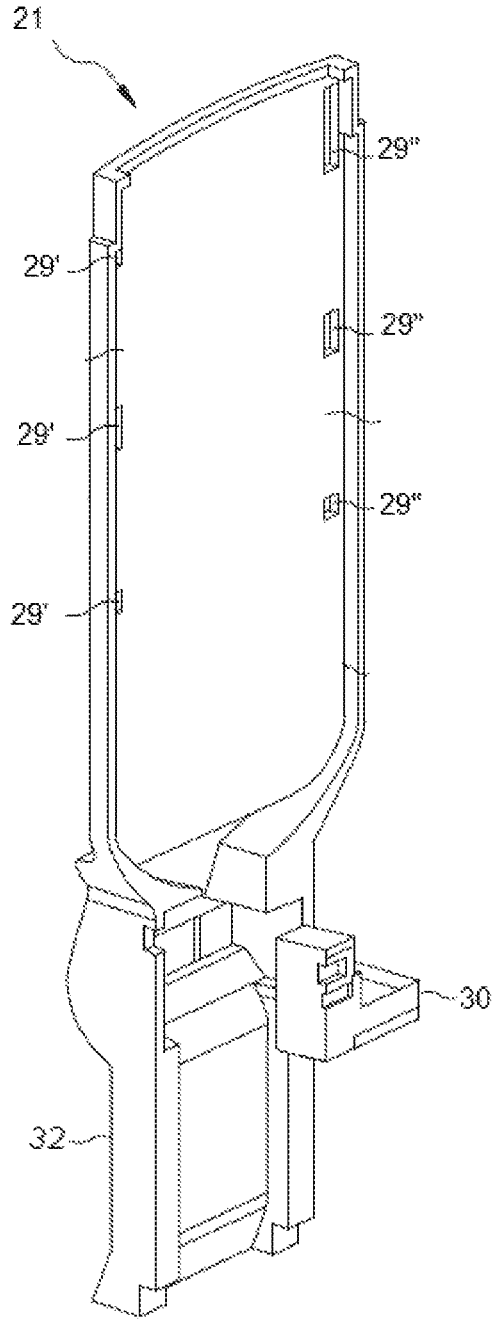
FIG. 4A illustrates a rear perspective view of an example air tower, according to an embodiment.

The upper side portions of the air tower 21 may be provided with air openings, such as air ports 29' and 29", for example. The air ports 29' and 29" allow the cool air from the fresh-food compartment 7 that passes upwardly through the air tower 21 to be discharged via the air ports 29' and 29" into the interior of the freezer compartment 11. The air ports 29' and 29" may be formed on each side portions of the air tower 21, and may be positioned or oriented variously as desired to direct the cool air towards certain parts of the freezer compartment 11. Any number of air ports 29' and 29" may be provided on each of the side portions of the air tower 21 in various shapes and sizes. For example, as illustrated in FIG. 4A, the upper air ports 29' and 29" can have larger cross-sectional dimensions than the middle and lower air ports 29' and 29" to balance out the air flow distribution and provide uniform cooling in the freezer compartment 11, since the upper air ports 29' and 29" are located furthest from the inlet at the lower portion of the air tower 21. In this manner, for a given air flow rate or pressure through the air tower 21, relatively the same amount or rate of airflow will be discharged out of the various air ports 29' and 29".

Figure 3B:
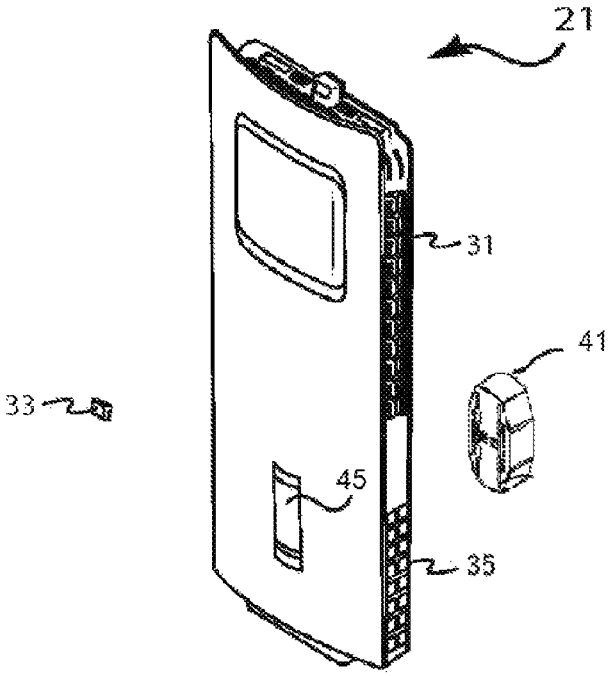
FIG. 3B is a separated view showing the air tower of FIG. 2, a damper, and a damper knob in perspective and illustrating their relative positions.
Figure 3C:
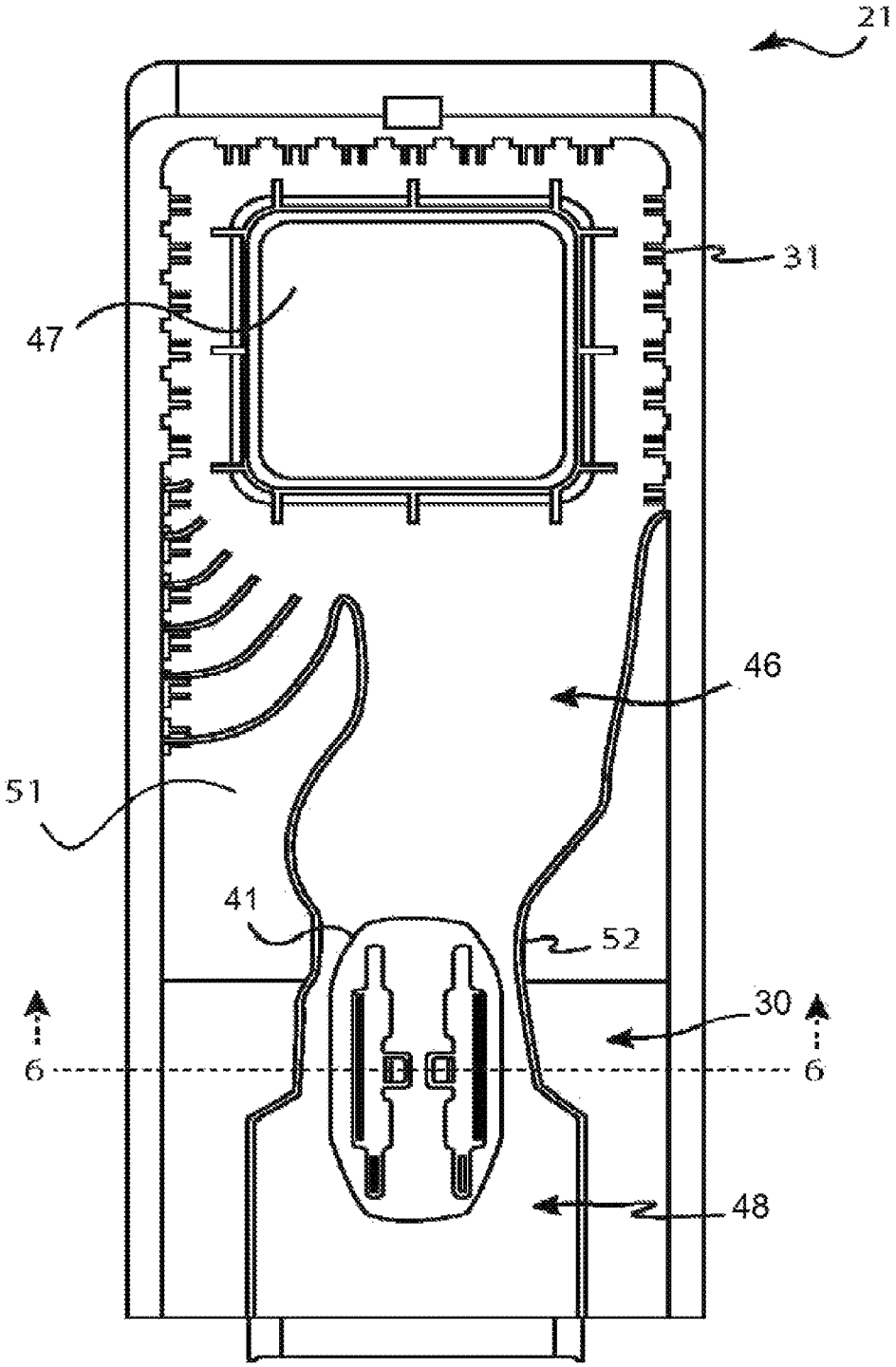
FIG. 3C shows a back view of the air tower of FIG. 2.

Referring to FIG. 3A, a damper 30 may be located in the lower center of the air tower 21. The damper 30 includes a movable part 39. As seen in FIG. 3A and FIG. 3B, the movable part 39 includes a main body 41 that is located between the air tower 21 and the evaporator coil cover 14, and a knob 33 attached to the main body 41 that protrudes away from the surface 43 of the air tower 21 through an opening 45 on the air tower 21. As best shown in FIG. 3C, the main body 41 of the movable part 39 divides the air passageway into a first plenum chamber 46 surrounding a recess area 47 located generally in the upper center of the back surface 51 of the air tower 21 for receiving the fan blades of the evaporator fan, a second plenum chamber 48 towards the bottom of the air passageway, and the damper 30 connecting the first plenum chamber 46 to the second plenum chamber 48, and defined by at least two spaced apart interior side walls 52. The movable part 39 is located inside the damper 30. Part of the cooling air diffused into the first plenum chamber 46 will enter the freezer compartment through the vents 31 disposed on top and upper sides of the air tower 21, and the remaining air will be directed to the second plenum chamber 45 through the damper 30, and further into the fresh-food compartment 7 via the air duct.

Another embodiment of the air tower 21 is shown in FIG. 4A. The lower portion 32 of the air tower 21 may include one or more dampers 30 that may control the flow of air that passes through the lower portion 32 of the air tower 21 and upwards into the air ports 29' and 29". The damper 30 may be designed to control the flow of air between the freezer compartment 11 and fresh-food compartment 7. The damper 30 may be attached in the air duct between the freezer compartment 11 and the fresh-food compartment 7 such that it may be bounded in the rear by a rear cover sheet (not shown in FIG. 4A) and in the front by the air tower 21. The damper 30 may be accessed for installation, service, or replacement from the rear side of the air tower 21, as will be described more fully herein.

Figure 4B:
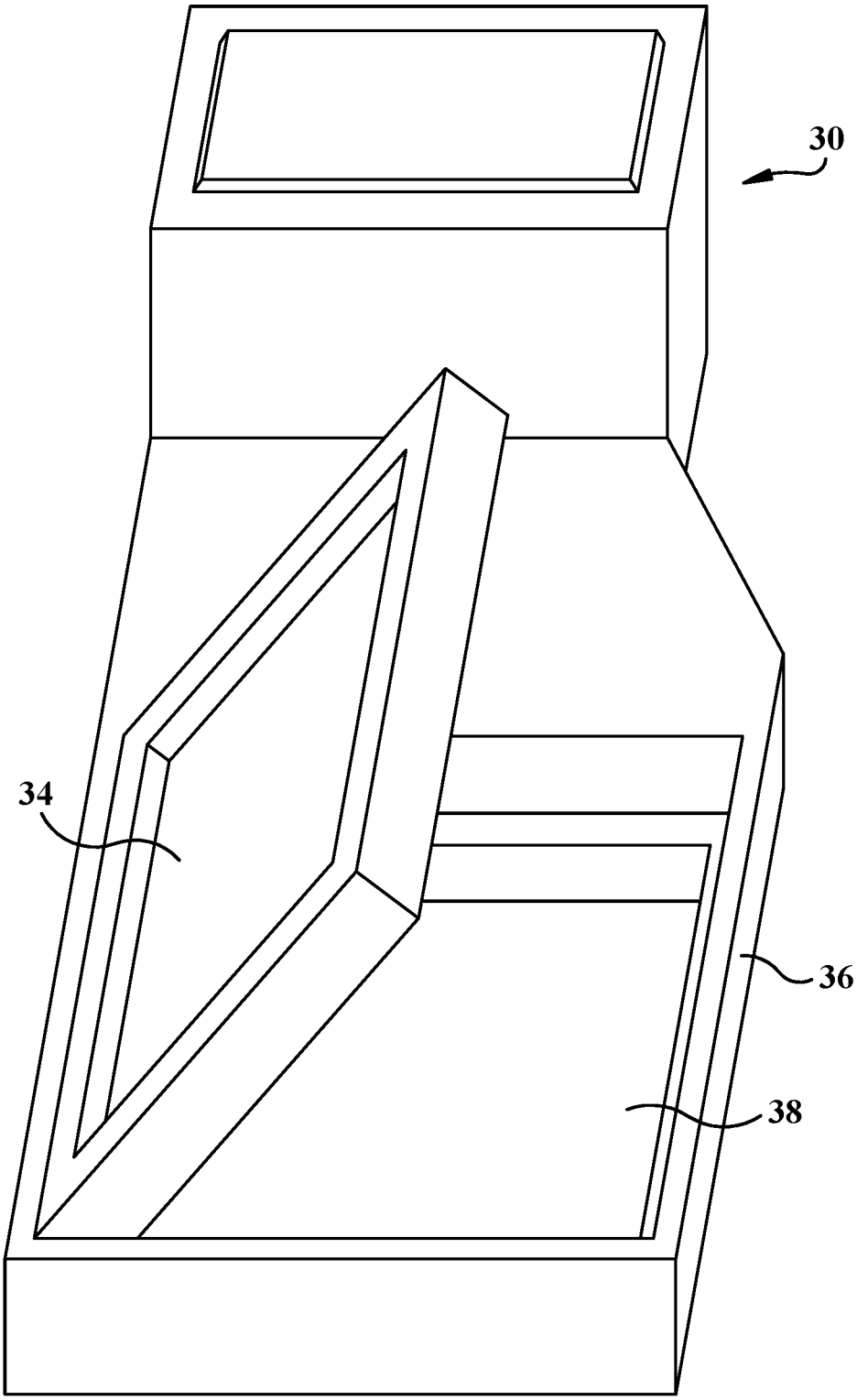
FIG. 4B illustrates a schematic perspective view of an example damper that is used within the various example air towers.

FIG. 4B shows an example of the damper 30. The damper 30 may include a damper door 34, damper door frame 36, and an opening 38 through which air may pass. When the damper door 34 is open, moisture from the fresh-food compartment 8 may accumulate on the damper door frame 84. If the damper door 34 is then closed all the way to a horizontal orientation, the damper door 34 may rest on the moisture-soaked damper door frame 84 and freeze shut. To reduce the risk of freezing, the damper door 34 may form an angle from the conventional fully horizontal closed position. The angle of the fully closed position may be, for instance, 9°. The open/closed position of the damper door 34 may be controlled manually. Therefore, the fresh-food 7 and freezer 11 compartments may be in fluid communication even when the damper door 34 is in its fully closed position. In this embodiment, the damper door 34 may not contact the frame 36 when in a fully closed position.

The opening and closing of the damper 30 can be controlled manually by the user, for example. The position of the damper 30 can be set to any position between a fully closed position and a fully open position to reach the desired temperature balance of the compartments. For example, when the temperature of fresh-food compartment 7 is above a predetermined fresh-food compartment 7 upper temperature limit, the damper 30 can be set to the full open position to provide the fastest cooling time to the fresh-food compartment 7. In contrast, the damper 30 can be set to the full closed position when the temperature of fresh-food compartment 7 is below a predetermined fresh-food compartment lower temperature limit to provide a slower cooling time to the fresh-food compartment 7. Further, if the fresh-food compartment temperature is between the fresh-food compartment upper and lower temperature limits, the damper 30 can be set to a position between the full open and full closed position to thereby maintain the fresh-food compartment 7 at a constant temperature. The operation of the damper door 34 may be prompted by the user to open and close, thus allowing more or less cold air from the freezer to pass through. For instance, if a sensor detects that the temperature in the fresh-food compartment 7 is too high, it may prompt the user (e.g., by providing a sound or visual alert, for example) to open the damper door 34. In addition or alternatively, the damper 30 may include a defrost heater to periodically melt frost that may form on the damper door 34 or the frame 36, which could inhibit air flow or damper operation.

The cooling/refrigeration system of a refrigerator cools the storage compartments (e.g., the freezer, fresh-food compartment, and/or the ice maker) of the refrigerator. The refrigeration system can include either a standard compressor or a variable speed compressor, a condenser, a condenser fan, and an evaporator connected in series and charged with a refrigerant from the compressor, and an evaporator fan. The evaporator fan circulates cooling air through the refrigerator compartments and improves heat transfer efficiency. The condenser expels heat withdrawn by the evaporator from the fresh-food compartment and the freezer compartment, respectively.

Figure 5:
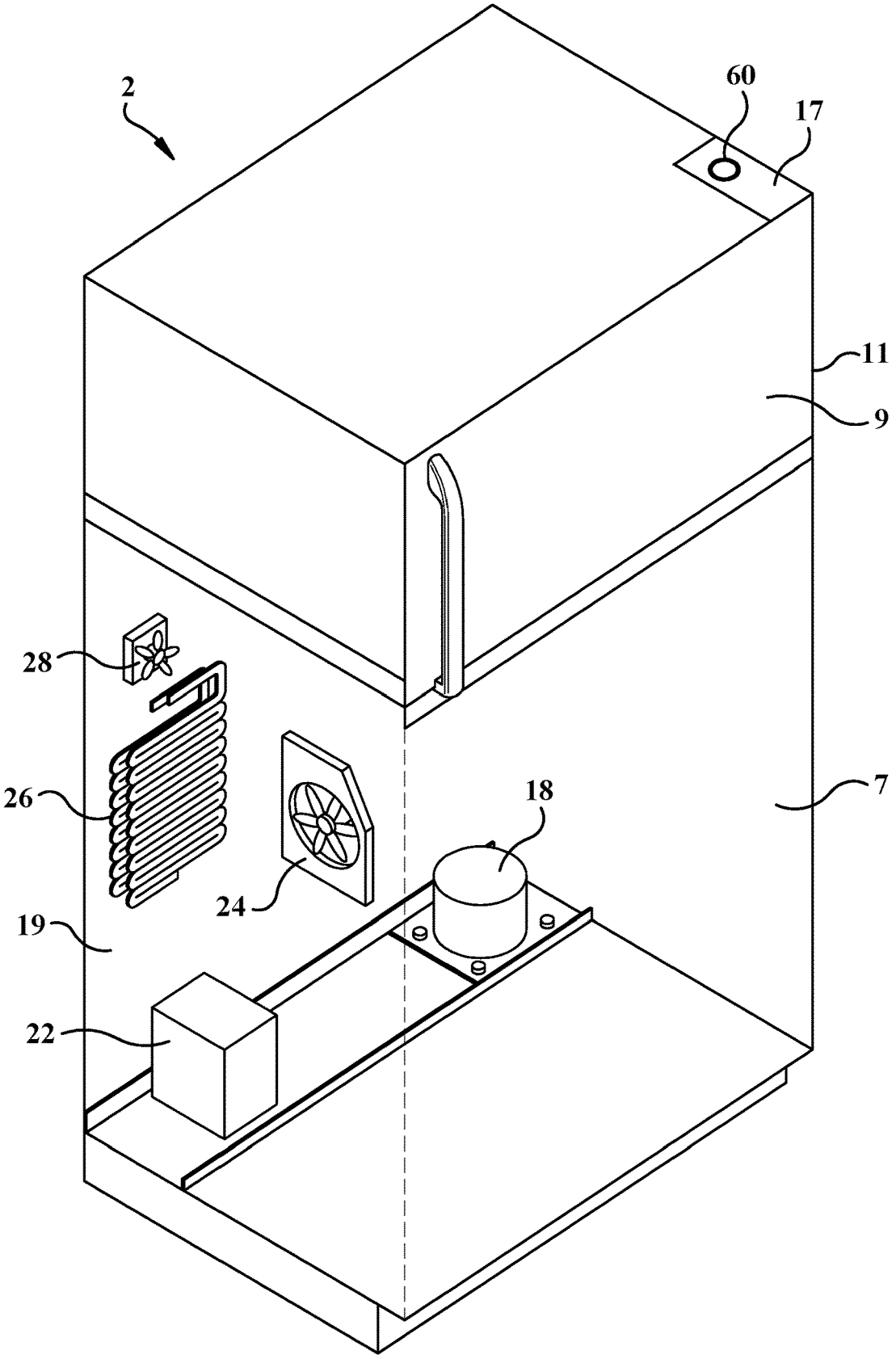
FIG. 5 is a perspective view of the refrigerator of FIG. 1, showing the location of the refrigerator system.

Referring to FIG. 5, an example cooling/refrigeration system of the refrigerator 2 includes a machine compartment 19 housing the refrigeration components, such as a variable speed compressor 18, a condenser 22 connected to the compressor 18, a condenser fan 24, an evaporator 26 connected in series and charged with a refrigerant, and a variable speed evaporator fan 28. The variable speed evaporator fan 28 circulates cooling air through the refrigerator compartments and improves heat transfer efficiency. The condenser 22 expels heat withdrawn by the evaporator 26 from the fresh-food compartment 7 and the freezer compartment 11, respectively. Negative temperature coefficient (NTC) thermistors, such as a fresh-food compartment temperature sensor 56 and a freezer temperature sensor 58 (not illustrated in FIG. 5, but discussed with reference to FIG. 6 below) can be provided inside the fresh-food compartment 7 and the freezer compartment 11 for sensing the fresh-food compartment temperature and the freezer compartment temperature, respectively. In the embodiments described below, however, the temperature control method described herein operates without inputs from the freezer temperature sensor 58 and the fresh-food compartment temperature sensor 56. Instead, input from the fresh-food compartment temperature sensor 56 may be used to control the on and off state of the compressor 18, provide alerts to the user regarding high temperature of the fresh-food compartment 7, or to estimate the ambient temperature via the virtual ambient temperature routine described below. Also the ambient temperature could be acquired externally from a network or connected appliances.

Figure 6:
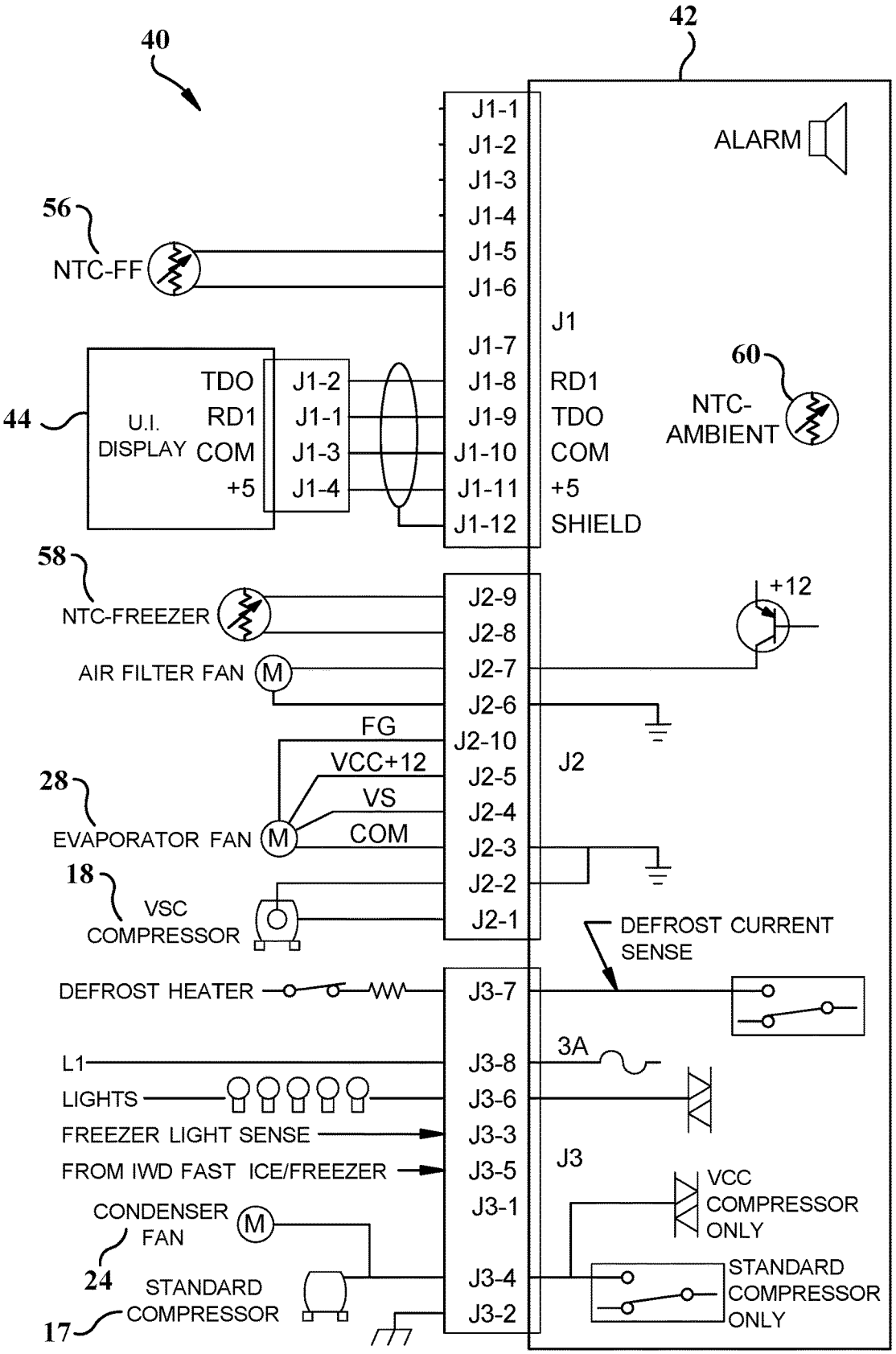
FIG. 6 is a schematic diagram of an electronic control system.

Referring to FIG. 6, the refrigerator 2 can further include an electronic microprocessor-based control system 40 for controlling the refrigeration components, such as the compressor 18, the condenser 22 and condenser fan 24, the evaporator 26 and evaporator fan 28, as well as non-refrigeration components, such as a user interface, indicator lights, alarms, etc. The control system 40 may include a main control board or controller 42 and a user interface/display board 44.

The controller 42 can be an electronic controller and may include a processor. The controller 42 can include one or more of a microprocessor, a microcontroller, a digital signal processor (DSP), an application specific integrated circuit (ASIC), a field-programmable gate array (FPGA), discrete logic circuitry, or the like. The controller 42 can further include memory and may store program instructions that cause the controller to provide the functionality ascribed to it herein. The memory may include one or more volatile, non-volatile, magnetic, optical, or electrical media, such as read-only memory (ROM), random access memory (RAM), electrically-erasable programmable ROM (EEPROM), flash memory, or the like. The controller 42 can further include one or more analog-to-digital (A/D) converters for processing various analog inputs to the controller 42. The controller 42 can be a dedicated controller that is used substantially only for controlling the temperature of the refrigeration compartments, or the controller can control a plurality of functions commonly associated with a refrigeration appliance, such as activating the compressor and the condenser fan, defrosting operations, and the like.

The user interface/display board 44 can communicate with the main control board 42 and can include communication means in the form of multiple control switches of any type known in the art to allow the user to communicate with the main control board 42. The user interface/display board 44 can further include a display portion for conveying information to the user. The display portion may be any type of display known in the art, such as a two-digit, 7-segment display that displays temperature either in degrees Fahrenheit or Celsius or a single-digit, 7-segment display that displays a temperature setting from 1 to 9.

The controller 42 can include input/output circuitry for interfacing with the various system components. For example, the controller 42 can receive and interpret temperature signals from an ambient temperature sensor 60, as well as from the fresh-food and freezer compartments sensors 56 and 58, and processes these signals to control the operation of the refrigeration and non-refrigeration components described above based on these signals. Specifically, inputs to the controller 42 can be provided from the ambient temperature sensor 60, from the freezer and the fresh-food compartment temperature sensors 56, 58, from the user interface 44, and from the compressor 18. Outputs from the controller 42 can control at least the energization of the compressor 18, the evaporator fan 28, and the condenser fan 22. The controller 42 can be connected to output alarm devices, such as light emitting elements or sound emitting elements. The controller 42 can also initiate regular defrost operations at standard intervals, which may be stored in the memory of the controller 42 to be selected according to operating conditions of the refrigeration system.

As mentioned above, some multi-cavity refrigeration appliances have only one automatically controlled compartment (e.g., a "master"), while the other compartments are designated as dependent or "slaves" and the temperature in a slave compartment is adjusted by moving a motorized or electronic damper. Efforts to use a Variable Speed Compressor (VSC) in these appliances are currently limited to narrow speed ranges, which reduces the potential benefits of a VSC in terms of energy consumption. For example, it is difficult to apply VSC to single circuit systems with motorized or electronic dampers which automatically compensate for ambient temperature changes. Because the change in speed affects the temperature balance among the compartments, temperature control of the "slave" compartment requires user actions to manually adjust the damper position, which results in a poor user experience.

The temperature control method described below uses a logic (software) control algorithm that controls the temperature of the "slave" compartments by using the ambient temperature (measured by an ambient temperature sensor or determined by a virtual ambient temperature estimation routine described below) to control a Variable Speed Compressor (VSC) and/or a variable speed evaporator fan, and a fixed mechanical damper or no damper at all. Changing the duty cycle of the evaporator fan motor adjusts the total airflow among the compartments, thereby affecting the evaporating temperature and adjusting relative cooling capacity to allow temperature control of the compartments differently from each other. Cooling capacity may be adjusted by adjusting a quantity of air flow or a quantity of refrigerant, for example, by adjusting fan speed or compressor speed, for example. Lowering the duty cycle of the evaporator fan motor allows using compressors with lower capacity while maintaining the temperature of the compartments, and results in energy efficiency with decreased noise and vibration from the compressor.

The cooling of the compartments can be controlled by a discrete digital logic or a controller 42 (shown in FIG. 6), for example, in accordance with output from the ambient temperature sensor 60 that measures the ambient temperature, an input of a set point temperature of the fresh-food compartment 7, and a freezer compartment 11 reference point. The ambient temperature sensor 60 is typically arranged outside the fresh-food compartment 7 and the freezer compartment 11. For example, as shown in FIG. 5, the ambient temperature sensor 60 may be arranged on a plate 17 that covers the upper door hinge (not shown in FIG. 5) of the door 9 of the freezer compartment 11. Alternatively, the ambient temperature sensor 60 may be arranged on the external panel of the refrigerator 2 outside the fresh-food compartment 7 by the machine compartment 19.

In certain embodiments, the ambient temperature can be inferred (e.g., sensed indirectly), without communicating with a physical ambient temperature sensor 60. Specifically, the controller 42 can be programmed to execute a virtual ambient temperature routine to estimate the ambient temperature or the heat load into the refrigeration cabinet based on the cooling/refrigeration system's response to the thermal load (e.g., whether the compressor 18 is running, how fast the compressor 18 is running, how long the compressor 18 is running, whether the evaporator fan 28 is running, the temperature of the fresh-food compartment 7, how effectively the refrigeration circuit is cooling the refrigerator's compartments, whether a defrost procedure to eliminate frost buildup on the evaporator coils is active, etc.) as explained below. The virtual ambient temperature evaluation solution can be applied either in addition to the ambient temperature sensor 60 (e.g., as a backup to improve the operation of the refrigerator 2 in case of failure of the ambient temperature sensor 60) or instead of the ambient temperature sensor 60 (i.e., no physical ambient temperature sensor 60 is part of the refrigerator 2).

At the initialization of the virtual ambient temperature evaluation algorithm, if a physical ambient temperature sensor 60 is not used, the initial value of the virtual ambient temperature is set to the temperature of the fresh-food compartment 7, as detected by the fresh-food temperature sensor 56. If a physical ambient temperature sensor 60 is used, the initial value of the virtual ambient temperature is set to the ambient temperature, as detected by the ambient temperature sensor 60.

Figure 7:
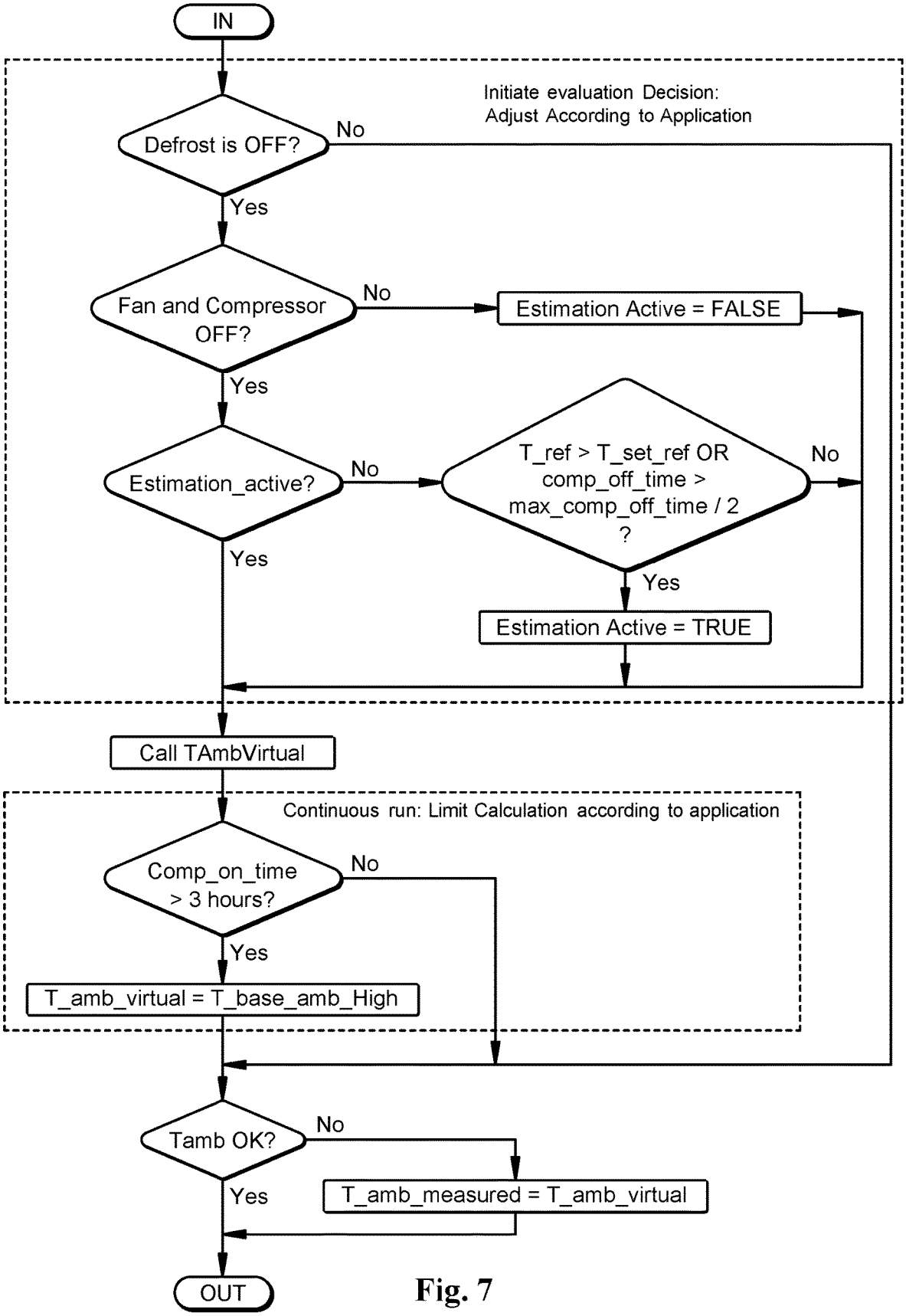
FIG. 7 is a flowchart illustrating a virtual ambient temperature routine.

The controller 42 calculates and can update the virtual ambient temperature when the defrost procedure to eliminate frost buildup on the evaporator coils is not active. For example, the controller 42 can infer the ambient temperature by monitoring the temperature of the fresh-food compartment 7, as detected by the fresh-food temperature sensor 56. The virtual ambient temperature can then be estimated as a linear function of the detected temperature of the fresh-food compartment 7. As illustrated in the flowchart of FIG. 7, the virtual ambient temperature estimation takes place when the compressor 18 and the evaporator fan 28 are OFF (i.e., when the temperature of the fresh-food compartment 7 increases). The virtual ambient temperature and its gradient are evaluated with a linear approximation by measuring the variation of the temperature of the fresh-food compartment 7 during the compressor 18 OFF cycle, avoiding thermal inertia by using one of two methods. In a first method, the temperature T_Ref of the fresh-food compartment 7 is compared to a set point temperature T_set_ref and the virtual ambient temperature estimation routine is initiated when the temperature T_Ref of the fresh-food compartment 7 is equal to or exceeds the set point temperature T_setref. In a second method, the virtual ambient temperature estimation routine is initiated when the compressor's 18 OFF time comp_off time is equal to or exceeds a half of the compressor's 18 maximum OFF time max_comp_off time/2.

In case of a continuous run of the compressor 18, for example, when the compressor 18 operates longer than a predetermined time period (such as 3 hours, for example), the controller 42 can infer that the ambient temperature is the maximum reference T_base_amb_High, which is a baseline for high ambient temperature (such as 32° C., for example).

In certain embodiments, instead of monitoring the temperature of the fresh-food compartment 7, as detected by the fresh-food temperature sensor 56, the controller 42 can infer the ambient temperature by monitoring the temperature of the freezer compartment 11, as detected by the freezer temperature sensor 58, or by monitoring the temperature of the evaporator 26, as detected by an evaporator temperature sensor located on or near the evaporator 26.

The controller 42 drives the variable-speed compressor 18 and the variable-speed evaporator fan 28 based on the ambient temperature detected from the ambient temperature sensor 60 or determined by the virtual ambient temperature estimation routine described above, the temperature of the fresh-food compartment set by the user, and the freezer compartment reference point. Specifically, the controller 42 is programmed to select a reference parameter HL_ratio, which is related to the speed of at least one of the variable speed compressor 18 and the variable speed evaporator fan 28. The reference parameter HL_ratio is proportional to the ratio between the difference between the ambient temperature (detected from the ambient temperature sensor 60 or determined by the virtual ambient temperature estimation routine described above) and the cavities' reference points from the design point to the current point of operation and the ratio between the difference between a baseline high ambient temperature and the cavities' reference points. For example, the controller 42 calculates the reference parameter HL_ratio using the formula:

$$\text{HL_ratio} = \frac{\text{HL_current}}{\text{HL_ref_High}}$$

where:

$$\text{HL_current} = \frac{\text{T_amb_measured} - \text{Ref_FZ}}{\text{T_amb_measured} - \text{Ref_FF}}$$

$$\text{HL_ref_High} = \frac{\text{T_base_amb_High} - \text{Base_FZ}}{\text{T_base_amb_High} - \text{Base_FF}}$$

T_amb_measured is the determined ambient temperature. Ref_FZ is a first reference for speed calculation equal to the freezer compartment reference point. The freezer compartment reference point is a constant-value reference parameter, loosely connected to a desirable freezer compartment temperature, that is determined by simulating (which might include testing) the characteristics of a particular system and is selected to obtain a desired freezer compartment temperature although the value of the freezer compartment reference point probably will not match the desired freezer compartment temperature value. For example, the freezer compartment reference point can have a value in a range of −30 to 10, whereas a desired freezer temperature is likely to be within a few degrees of −18° C. Ref_FF is the set point temperature of the fresh-food compartment. T_base_amb_High is a baseline for high ambient temperature test condition that delivers the desirable performance of the refrigerator 2. The range of values for the high ambient temperature T_base_amb_High test condition can be between 21° C. and 38° C., for example, and the value of T_base_amb_High can be set to 32° C., for example. Base_FZ, which is the same parameter as Ref_FZ, is the first reference for speed calculation equal to the freezer compartment reference point. Base_FF is a second reference for speed calculation (set by the manufacturer) equal to the fresh-food compartment reference point.

Figure 8:
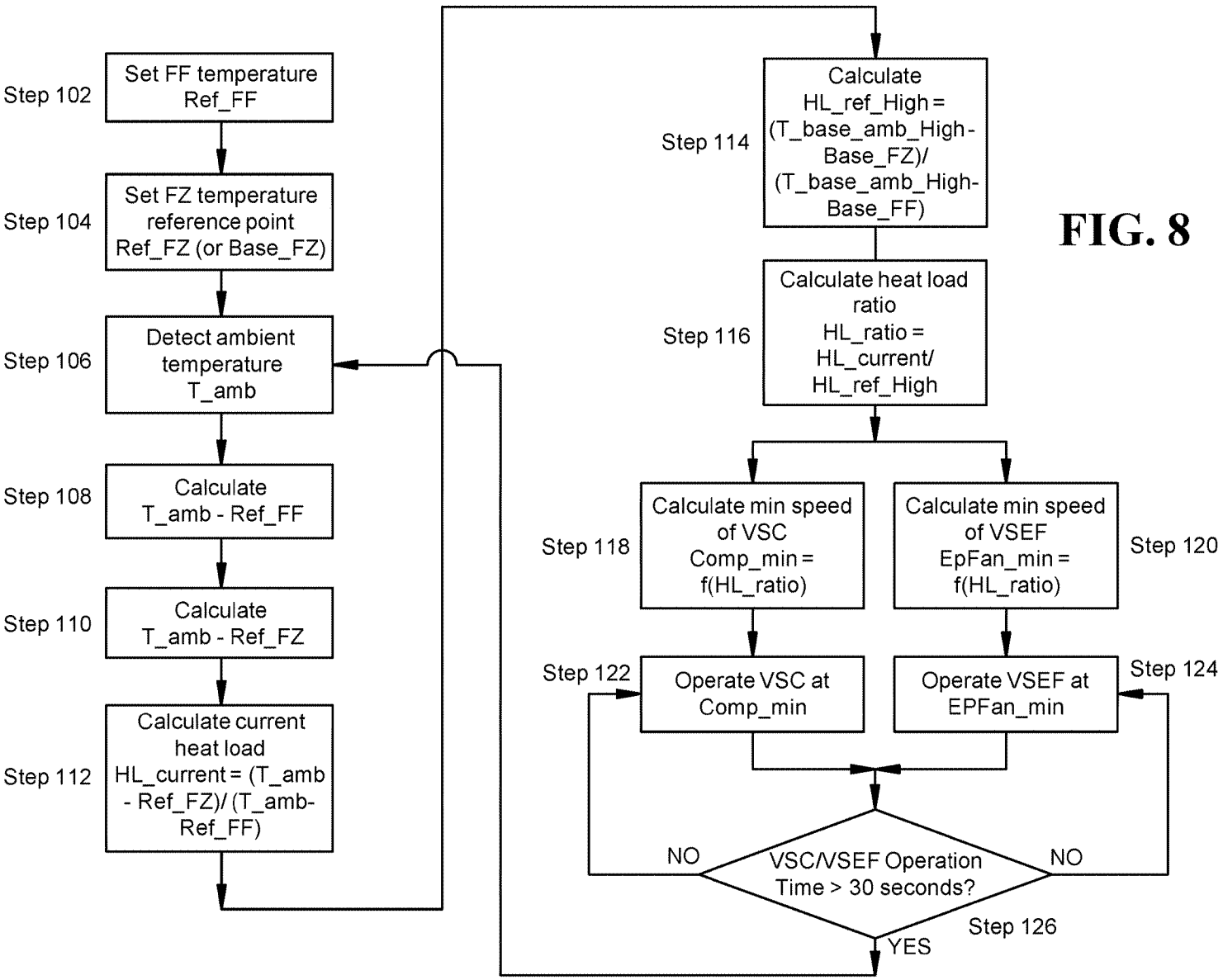
FIG. 8 is a flowchart illustrating the temperature control method.

As illustrated in the flowchart in FIG. 8, the process begins in Step 102 by setting the set point temperature Ref_FF of the fresh-food compartment 7. The set point temperature Ref_FF of the fresh-food compartment 7 can be selected by the user as a desired temperature using a fresh-food compartment temperature selector (e.g., potentiometer or digital), which may be disposed within the fresh-food compartment 7, for example. The set point temperature Ref_FF of the fresh-food compartment 7 can have a value between 1 degree Celsius and 8 degrees Celsius, for example. Alternatively, the set temperature Ref_FF of the fresh-food compartment 7 can have a value between −3 degrees Celsius and 14 degrees Celsius, for example.

In Step 104, the process continues by setting a freezer compartment reference point Ref_FZ (or Base_FZ). The freezer compartment reference point Ref_FZ is a reference parameter for speed calculation with a value between −30 and 10, which is determined through simulation or laboratory test. An alternative range for the freezer compartment reference point Ref_FZ can include values from −25 to 0, for example. This selection is not necessarily present at user level as a single value for Ref_FZ can be defined by the manufacturer and included into the control software. The freezer compartment reference point Ref_FZ has a weak connection to the temperature of the freezer compartment 11, but effects how the freezer compartment responds to changes in the temperature of the fresh-food compartment 7. The freezer compartment 11 reference point Ref_FZ reflects the sensitivity of the freezer compartment 11 relative to the set point temperature Ref_FF of the fresh-food compartment 7. The higher the value of the freezer compartment reference point Ref_FZ is, the larger will be the compensation due to changes in the Ref_FF. Alternatively, the freezer compartment reference point Ref_FZ can be present at user level as a value related to the set point temperature of the Freezer compartment and can be based on user input via the user interface 44. If Ref_FZ is based on user input, Base_FZ can be a reference parameter for speed calculation with a value, for example, between −30 and 10, which is determined through simulation or laboratory testing.

In Step 106, the controller 42 detects the ambient temperature T_amb (short of T_amb-measured) based on measurements by the ambient temperature sensor 60 or as determined by the virtual ambient temperature estimation routine described above or alternatively acquired externally from a network or connected appliances.

In Step 108, the controller 42 calculates the difference between the ambient temperature T_amb determined in Step 106 and the set point temperature Ref_FF of the fresh-food compartment 7, by subtracting the set point temperature Ref_FF of the fresh-food compartment 7 from the ambient temperature T_amb.

In Step 110, the controller 42 calculates the difference between the ambient temperature T_amb determined in Step 106 and the freezer compartment reference point Ref_FZ set in Step 104, by subtracting the freezer compartment reference point Ref_FZ from the ambient temperature T_amb.

In Step 112, the controller 42 calculates a current heat load HL_current as a ratio between the difference between the ambient temperature T_amb determined in Step 106 and the freezer compartment reference point Ref_FZ set in Step 104 and the difference between the ambient temperature T_amb determined in Step 106 and the set point temperature Ref_FF of the fresh-food compartment 7. Specifically, the controller 42 calculates the current heat load HL_current using the formula:

$$HL_current = \frac{T_amb_measured - Ref_FZ}{T_amb_measured - Ref_FF},$$

where T_amb_measured is the ambient temperature, Ref_FZ is a first reference for speed calculation equal to the freezer compartment reference point, and Ref_FF is the set point temperature of the fresh-food compartment.

In Step 114, the controller 42 calculates a parameter HL_ref_High as a ratio between the difference between a high ambient temperature T_base_amb_High test condition (described below) and the freezer compartment reference point Base_FZ set in Step 104 and the difference between the high ambient temperature T_base_amb_High test condition and the second reference for speed calculation Base_FF which is equal to the fresh-food compartment 7 reference point. Specifically, the controller 42 calculates the parameter HL_ref_High using the formula:

$$HL_ref_High = \frac{T_base_amb_High - Base_FZ}{T_base_amb_High - Base_FF},$$

where T_base_amb_High is a baseline for high ambient temperature test condition that delivers the desirable performance of the refrigerator 2, Base_FZ is the same parameter as Ref_FZ set in Step 104, which is the first reference for speed calculation equal to the freezer compartment reference point, and Base_FF is the second reference for speed calculation equal to the fresh-food compartment reference point.

In Step 116, the controller 42 calculates a heat load ratio HL_ratio as a ratio between the current heat load HL_current calculated in Step 112 and the parameter HL_ref_High calculated in Step 114:

$$HL_ratio = \frac{HL_current}{HL_ref_High}.$$

In Step 118, the controller 42 calculates a minimum speed Comp_min (short of comp_rpm_min) of the variable-speed compressor 18 (shown in FIG. 8 as "VSC" for brevity) as a function of the calculated heat load ratio HL_ratio using the formula:

$$comp_rpm_min = f(HL_ratio)$$

The minimum speed Comp_min of the variable-speed compressor 18 can be a linear or a non-linear function of the calculated heat load ratio HL_ratio.

More specifically, the controller 42 can calculate the minimum speed Comp_min (short of comp_rpm_min) of the variable-speed compressor 18 using the formula:

$$comp_rpm_min = Cp_A * HL_ratio + Cp_B,$$

in which linearity constants Cp_A and Cp_B, are calculated through simulation and/or laboratory testing during start-up of the refrigerator. For example, the linearity constants Cp_A and Cp_B are calculated using the formulas:

$$Cp_A = (comp_rpm_base_High - comp_rpm_base_Low)/(1 - HL_Base) \text{ and}$$

$$Cp_B = (comp_rpm_base_Low - comp_rpm_base_High * HL_Base)/(1 - HL_Base),$$

where comp_rpm_base_High defines the compressor speed in revolutions per minute (RPM) at a high ambient temperature T_base_amb_High test condition that delivers the desirable performance of the refrigerator 2; comp_rpm_base_Low defines the compressor speed in revolutions per minute (RPM) at a low ambient temperature T_base_amb_Low test condition that delivers the desirable performance of the refrigerator 2; and HL_Base is a simulation variable used to calculate HL_ratio. The range of values for the high ambient temperature T_base_amb_High test condition can be between 21° C. and 38° C., for example, and the value of T_base_amb_High can be set to 32° C., for example. The range of values for the low ambient temperature T_base_amb_Low test condition can be between 10° C. and 20° C., for example, and the value of T_base_amb_Low can be set to 10° C., for example.

Alternatively, the controller 42 can calculate the minimum speed Comp_min (short of comp_rpm_min) of the variable-speed compressor 18 using a non-linear function, such as a quadratic function, for example:

$$comp_rpm_min = A * HL_ratio^2 + B * HL_ratio + C, \text{ or any other function.}$$

Regardless of the specific non-linear function used by the controller 42 to calculate the minimum speed Comp_min (short of comp_rpm_min) of the variable-speed compressor 18, the controller 42 uses the heat load ration HL_ratio in these calculations.

In Step 120, the controller 42 calculates a minimum speed EPFan_min (short of fan_RPM_evap_min) of the variable-speed evaporator fan 28 (shown in FIG. 8 as "VSEF" for brevity) as a function of the calculated heat load ratio HL_ratio using the formula:

$$fan_RPM_evap_min = f(HL_ratio)$$

The minimum speed EPFan_min of the variable-speed evaporator fan 28 can be a linear or a non-linear function of the calculated heat load ratio HL_ratio.

More specifically, the controller 42 can calculate the minimum speed EPFan_min (short of fan_PMW_evap_min) of the variable-speed evaporator fan 28 using the formula:

$$fan_PWM_evap_min = Fan_A * HL_ratio + Fan_B,$$

in which constants Fan_A and Fan_B, are calculated through simulation and/or laboratory testing during start-up of the refrigerator. For example, the constants Fan_A and Fan_B are calculated using the formulas:

$$Fan_A = (fan_PWM_base_High - fan_PWM_base_low)/(1 - HL_Base) \text{ and}$$

$$Fan_B = (fan_PWM_base_low - fan_PWM_base_High * HL_Base)/(1 - HL_Base),$$

where fan_PWM_base_High defines the evaporator fan speed, which can be obtained by pulse width modulation (PWM) of the electric power supplied to the evaporator fan motor, at a high ambient temperature T_base_amb_High test condition that delivers the desirable performance of the refrigerator 2; fan_PWM_base_low defines the evaporator fan speed, which can be obtained by pulse width modulation (PWM) of the electric power supplied to the evaporator fan motor, at a low ambient temperature T_base_amb_Low test condition that delivers the desirable performance of the refrigerator 2; and HL_Base is a simulation variable used to calculate HL_current. The range of values for the high ambient temperature T_base_amb_High test condition can be between 21° C. and 38° C., for example, and the value of T_base_amb_High can be set to 32° C., for example. The range of values for the low ambient temperature T_base_amb_Low test condition can be between 10° C. and 20° C., for example, and the value of T_base_amb_Low can be set to 10° C., for example.

Alternatively, the controller 42 can calculate the minimum speed EPFan_min (short of fan_PMW_evap_min) of the variable-speed evaporator fan 28 using a non-linear function, such as a quadratic function, for example:

$$\text{fan_PWM_evap_min}=A*\text{HL_ratio}^2+B*\text{HL_ratio}+C,$$
or any other function.

Regardless of the specific non-linear function used by the controller 42 to calculate the minimum speed EPFan_min (short of fan_PMW_evap_min) of the variable-speed evaporator fan 28, the controller 42 uses the heat load ration HL_ratio in these calculations.

In Step 122, the controller 42 drives the variable-speed compressor 18 at the calculated (in Step 118) minimum variable-speed compressor speed Comp_min.

In Step 124, the controller 42 drives the variable-speed evaporator fan 28 at the calculated (in Step 120) minimum variable-speed evaporator fan speed EPFan_min.

The controller 42 drives the variable-speed compressor 18 at the calculated minimum variable-speed compressor speed Comp_min and the variable-speed evaporator fan 28 at the calculated (in Step 120) minimum variable-speed evaporator fan speed EPFan_min for a predetermined period of time, such as 30 seconds, for example. However, the predetermined period of time does not necessarily have to be 30 seconds, but can instead be a continuous check, or a discrete check of 90 seconds or longer, such as 3, 5, or 10 minutes, for example. After the variable-speed compressor 18 and the variable-speed evaporator fan 28 have operated for the predetermined period of time (30 seconds in the specific example in FIG. 8), in Step 126, the controller 42 restarts the calculations of the minimum variable-speed compressor speed Comp_min and the minimum variable-speed evaporator fan speed EPFan_min by going back to Step 106, where the ambient temperature T_amb is again detected and the calculations in steps 108 through 120 are repeated with the new detected ambient temperature T_amb.

The calculated minimum speeds Comp_min and EPFan_min of the variable-speed compressor 18 and the variable-speed evaporator fan 28, respectively, are the minimum speeds that are necessary to maintain the temperatures of the fresh-food compartment 7 and the freezer compartment 11, which results in energy efficiency and temperature accuracy. That is, the controller 42 drives the variable-speed compressor 18 until the inner temperature of the fresh-food compartment 7 reaches the temperature set by the user. The controller 42 indirectly ensures that the freezer compartment 7 is maintained within the range selected by the user through, for instance, the manually controlled damper, by promoting the right cooling capacity distribution between the fresh-food compartment 11 and the freezer compartment 7 through the calculated minimum speeds of the variable-speed compressor 18 and/or the minimum variable-speed evaporator fan 28 using, for instance, pulse width modulation (PWM). In other words, if the speed of the variable-speed evaporator fan 28 increases and/or the variable-speed compressor 18 speed is reduced, less cooling capacity is delivered to the freezer compartment 11 causing the freezer compartment 7 temperature to increase. When the speed of the variable-speed evaporator fan 28 decreases and/or the variable-speed compressor 18 speed is increased more cooling capacity is delivered to the freezer compartment 11 causing the freezer compartment 7 temperature to decrease. In other words, the above-described temperature control algorithm allows temperature control of the fresh-food compartment 11 and the freezer compartment 7 separately and independently from each other. Thus, the adjustment of the total quantity of airflow and/or the total cooling capacity delivered by the compressor to the system allows the controlling of the temperature difference between the fresh-food compartment 11 and the freezer compartment 7 without adjusting the position of the damper 30.

In some embodiments, the controller 42 can be a proportional integral ("PI") or a proportional-integral-derivative ("PID") controller programmed to increase the working speed of at least one of the variable speed compressor 18 and the variable speed evaporator fan 28 above the calculated minimum speeds speed Comp_min and EPFan_min of the variable speed compressor 18 and the variable speed evaporator fan 28, respectively, in response to door openings, warm loads, and high ambient temperatures.

The temperature control method of the present invention may be incorporated in the existing control system of the refrigeration appliance.

The present invention provides a temperature control method in a multi-cavity refrigerator by using a fixed mechanical damper (or no damper at all) and the ambient temperature to control a variable-speed compressor and/or a variable-speed evaporator fan, which solves the problem of limiting the speed range of the variable-speed compressor when an electronically-controlled damper is used. The temperature control method described above improves the energy efficiency of the refrigeration system by ensuring that a minimum temperature of a "slave" compartment is always met within the specified range for the ambient temperature.

Many other example embodiments can be provided through various combinations of the above described features. Although the embodiments described hereinabove use specific examples and alternatives, it will be understood by those skilled in the art that various additional alternatives may be used and equivalents may be substituted for elements and/or steps described herein, without necessarily deviating from the intended scope of the application. Modifications may be desirable to adapt the embodiments to a particular situation or to particular needs without departing from the intended scope of the application. It is intended that the application not be limited to the particular example implementations and example embodiments described herein, but that the claims be given their broadest reasonable interpretation to cover all novel and non-obvious embodiments, literal or equivalent, disclosed or not, covered thereby.

What is claimed is:

1. A refrigeration appliance, comprising:

a fresh-food compartment configured for storing food items at a first target temperature above zero degrees Celsius;

a freezer compartment configured for storing food items at a second target temperature below zero degrees Celsius;

a refrigeration circuit configured for cooling the fresh-food compartment and the freezer compartment, the circuit having a variable speed compressor, an evaporator, and a variable speed evaporator fan; and a controller operatively connected to the refrigeration circuit and programmed to:

determine a difference between an ambient temperature and a set point temperature of the fresh-food compartment;

determine a difference between the ambient temperature and a freezer compartment reference point;

determine a difference between an ambient temperature value higher than an expected normal ambient temperature and the freezer compartment reference point;

determine a difference between the ambient temperature value higher than the expected normal ambient temperature and a fresh-food compartment reference point;

calculate a current heat load as a ratio between the difference between the ambient temperature and the set point temperature of the fresh-food compartment and the difference between the ambient temperature and the freezer compartment reference point;

calculate a second heat load as a ratio between the difference between the ambient temperature value higher than the expected normal ambient temperature and the freezer compartment reference point and the difference between the ambient temperature value higher than the expected normal ambient temperature and the fresh-food compartment reference point;

calculate a speed of one or both of the variable speed compressor and the variable speed evaporator fan as a function of the calculated current heat load and the second heat load; and operate one or both of the variable speed compressor and the variable speed evaporator fan at the calculated speed of the variable speed compressor and the variable speed evaporator fan, respectively.

2. The refrigeration appliance of claim 1, wherein the ambient temperature is determined based on a measurement by an ambient temperature sensor.

3. The refrigeration appliance of claim 1, wherein the ambient temperature is determined virtually by an estimation based on a response to a thermal load of the refrigerator.

4. The refrigeration appliance of claim 1, further comprising a cooling air channel between the fresh-food compartment and the freezer compartment, wherein the cooling air channel between the fresh-food compartment and the freezer compartment is formed as a fixed cooling air channel.

5. The refrigeration appliance of claim 1, wherein the set point temperature of the fresh-food compartment is based on user input via a user interface.

6. The refrigeration appliance of claim 1, wherein the freezer compartment reference point is a reference parameter determined through simulation and/or laboratory testing with a value between −30 and 10.

7. The refrigeration appliance of claim 4, wherein dimensions of the cooling air channel between the fresh-food compartment and the freezer compartment are controlled by a manual damper configured to be operated by a user.

8. The refrigeration appliance of claim 4, wherein the controller is further programmed to adjust cooling capacity distribution between the fresh-food compartment and the freezer compartment based on the calculated speed of at least one of the variable speed compressor and the variable speed evaporator fan.

9. The refrigeration appliance of claim 4, wherein the controller is further programmed to adjust relative quantities of airflow to the fresh-food compartment and the freezer compartment, respectively, based on the calculated speed of at least one of the variable speed compressor and the variable speed evaporator fan.

10. The refrigeration appliance of claim 1, wherein the controller is a proportional integral ("PI") or a proportional-integral-derivative ("PID") controller programmed to increase a working speed of at least one of the variable speed compressor and the variable speed evaporator fan above the calculated speed of at least one of the variable speed compressor and the variable speed evaporator fan in response to door openings, warm loads, and high ambient temperatures.

11. The refrigeration appliance of claim 1, wherein the controller being programmed to calculate the speed of one or both of the variable speed compressor and the variable speed evaporator fan as the function of the calculated current heat load (HL_current) includes the controller being programmed to calculate the speed of one or both of the variable speed compressor and the variable speed evaporator fan as a function of a heat load ratio HL_ratio, wherein the controller is programmed to calculate the heat load ratio HL_ratio using a formula:

$$\text{HL_ratio} = \frac{\text{HL_current}}{\text{HL_ref_High}}$$

wherein:

$$\text{HL_current} = \frac{\text{T_amb_measured} - \text{Ref_FZ}}{\text{T_amb_measured} - \text{Ref_FF}}$$

$$\text{HL_ref_High} = \frac{\text{T_base_amb_High} - \text{Base_FZ}}{\text{T_base_amb_High} - \text{Base_FF}},$$

wherein T_amb_measured is the ambient temperature, Ref_FZ is a reference for speed calculation equal to the freezer compartment set point, Ref_FF is the set point temperature of the fresh-food compartment, T_base_amb_High is a reference value selected as the value higher than the expected normal ambient temperature, Base_FZ is a reference for speed calculation equal to the freezer compartment reference point, and Base_FF is a reference for speed calculation equal to the fresh-food compartment reference point.

12. The refrigeration appliance of claim 10, wherein the controller is programmed to calculate the speed of at least one of the variable speed compressor and the variable speed evaporator fan in discrete or continuous time intervals as a linear or non-linear function of the calculated heat load ratio HL_ratio, wherein respective speed of the variable speed compressor and the speed of the variable speed evaporator fan equations are determined in simulation or laboratory testing through curve fitting as follows:

$$\text{comp_rpm_min} = f(\text{HL_ratio})$$

$$\text{fan_RPM_evap_min} = f(\text{HL_ratio}).$$

13. A method of controlling temperature in cavities of a refrigerator cooled by a refrigeration circuit having a variable speed compressor, an evaporator, and a variable speed evaporator fan, the method comprising the steps of:

determining an ambient temperature;

determining a difference between the ambient temperature and a set point temperature of a fresh-food compartment;

determining a difference between the ambient temperature and a freezer compartment reference point;

determining a difference between an ambient temperature value higher than an expected normal ambient temperature and the freezer compartment reference point;

determining a difference between the ambient temperature value higher than the expected normal ambient temperature and a fresh-food compartment reference point;

calculating a current heat load as a ratio between the difference between the ambient temperature and a set point temperature of the fresh-food compartment and the difference between the ambient temperature and a freezer compartment reference point;

calculating a second heat load as a ratio between the difference between the ambient temperature value higher than the expected normal ambient temperature and the freezer compartment reference point and the difference between the ambient temperature value higher than the expected normal ambient temperature and the fresh-food compartment reference point;

calculating a speed of one or both of the variable speed compressor and the variable speed evaporator fan as a function of the calculated current heat load and the calculated second heat load; and operating one or both of the variable speed compressor and the variable speed evaporator fan at the calculated speed of the variable speed compressor and the variable speed evaporator fan, respectively.

14. The method according to claim 13, wherein the ambient temperature is determined based on a measurement by an ambient temperature sensor.

15. The method according to claim 13, wherein the ambient temperature is determined virtually by an estimation based on a response to a thermal load of the refrigerator.

16. The method according to claim 15, wherein the ambient temperature is determined virtually as a linear approximation by measuring a temperature in the fresh-food compartment during an off cycle of the variable speed compressor.

17. The method according to claim 13, further comprising adjusting relative cooling capacity to the fresh-food compartment and the freezer compartment, respectively, based on the calculated speed of at least one of the variable speed compressor and the variable speed evaporator fan.

18. The method according to claim 13, wherein the set point temperature of the fresh-food compartment is based on user input via a user interface.

19. The method according to claim 13, wherein the freezer compartment reference point is a reference parameter determined through simulation and/or laboratory testing with a value between −30 and 10.

20. The method according to claim 13, further comprising selecting a reference parameter HL_ratio related to the speed of at least one of the variable speed compressor and the variable speed evaporator fan, wherein the reference parameter HL_ratio is proportional to a ratio between the current heat load and a ratio between a difference between the ambient temperature value higher than the expected normal ambient temperature and the cavities' reference points.

21. The method according to claim 20, wherein the reference parameter HL_ratio is calculated using a formula:

$$\text{HL_ratio} = \frac{\text{HL_current}}{\text{HL_ref_High}}$$

wherein:

$$\text{HL_current} = \frac{\text{T_amb_measured} - \text{Ref_FZ}}{\text{T_amb_measured} - \text{Ref_FF}}$$

$$\text{HL_ref_High} = \frac{\text{T_base_amb_High} - \text{Base_FZ}}{\text{T_base_amb_High} - \text{Base_FF}},$$

T_amb_measured is the determined ambient temperature, Ref_FZ is a reference for speed calculation equal to the freezer compartment reference point, Ref_FF is the set point temperature of the fresh-food compartment, T_base_amb_High is the ambient temperature value higher than the expected normal ambient temperature, Base_FZ is a reference for speed calculation equal to the freezer compartment reference point, and Base_FF is a reference for speed calculation equal to the fresh-food compartment reference point.

22. The method according to claim 21, wherein the controller calculates the speed of at least one of the variable speed compressor and the variable speed evaporator fan in discrete or continuous time intervals as a linear or non-linear function of the calculated heat load ratio HL_ratio, wherein respective speed of the variable speed compressor and the speed of the variable speed evaporator fan equations are determined in simulation or laboratory testing through curve fitting as follows:

$$\text{comp_rpm_min} = f(\text{HL_ratio})$$

$$\text{fan_RPM_evap_min} = f(\text{HL_ratio}).$$

23. The method according to claim 13, further comprising increasing a working speed of at least one of the variable speed compressor and the variable speed evaporator fan above the calculated speed of at least one of the variable speed compressor and the variable speed evaporator fan in response to door openings, warm loads, and high ambient temperatures.

* * * * *